US011810771B2

(12) United States Patent
Hager

(10) Patent No.: US 11,810,771 B2
(45) Date of Patent: Nov. 7, 2023

(54) FOURIER TRANSFORM MASS SPECTROMETER BASED ON USE OF A FRINGING FIELD TO CONVERT RADIAL OSCILLATIONS OF EXCITED IONS TO AXIAL OSCILLATIONS

(71) Applicant: DH Technologies Development Pte. Ltd., Singapore (SG)

(72) Inventor: James Hager, Mississauga (CA)

(73) Assignee: DH Technologies Development Pte. Ltd., Singapore (SG)

( * ) Notice: Subject to any disclaimer, the term of this patent is extended or adjusted under 35 U.S.C. 154(b) by 533 days.

(21) Appl. No.: 16/482,476

(22) PCT Filed: Jan. 29, 2018

(86) PCT No.: PCT/IB2018/050532
§ 371 (c)(1),
(2) Date: Jul. 31, 2019

(87) PCT Pub. No.: WO2018/142265
PCT Pub. Date: Aug. 9, 2018

(65) Prior Publication Data

US 2021/0134573 A1 May 6, 2021

Related U.S. Application Data

(60) Provisional application No. 62/453,167, filed on Feb. 1, 2017.

(51) Int. Cl.

| | |
|---|---|
| ***H01J 49/00*** | (2006.01) |
| ***H01J 49/06*** | (2006.01) |
| ***H01J 49/42*** | (2006.01) |

(52) U.S. Cl.
CPC ..... *H01J 49/0031* (2013.01); *H01J 49/063* (2013.01); *H01J 49/067* (2013.01); *H01J 49/427* (2013.01)

(58) Field of Classification Search
CPC .... H01J 49/0031; H01J 49/063; H01J 49/067; H01J 49/427
(Continued)

(56) References Cited

U.S. PATENT DOCUMENTS

2005/0045817 A1* 3/2005 Yamaguchi ..... H01J 49/408 250/287
2007/0273385 A1 11/2007 Makarov et al.
(Continued)

OTHER PUBLICATIONS

International Search Report and Written Opinion for PCT/IB2018/050532 dated Jan. 29, 2018.

*Primary Examiner* — Kiet T Nguyen

(57) ABSTRACT

In one aspect, a mass analyzer is disclosed, which comprises a quadrupole having an input end for receiving ions and an output end through which ions can exit the quadrupole, said quadrupole having a plurality of rods to at least some of which an RF voltage can be applied for generating a quadrupolar field for causing radial confinement of the ions as they propagate through the quadrupole and further generating fringing fields in proximity of said output end. The mass analyzer further includes at least a voltage source for applying a voltage pulse to at least one of said rods so as to excite radial oscillations of at least a portion of the ions passing through the quadrupole at secular frequencies thereof, where the radially-excited ions interact with the fringing fields as they exit the quadrupole such that their radial oscillations are converted into axial oscillations.

9 Claims, 14 Drawing Sheets

(58) Field of Classification Search
USPC ..... 250/281, 282
See application file for complete search history.

(56) References Cited

U.S. PATENT DOCUMENTS

| | | | | |
|---|---|---|---|---|
| 2008/0149825 | A1 | 6/2008 | Kozlovski et al. | |
| 2009/0194688 | A1 | 8/2009 | Bateman et al. | |
| 2010/0019143 | A1 | 1/2010 | Dobson et al. | |
| 2012/0193529 | A1 | 8/2012 | Nikolaev et al. | |
| 2014/0374592 | A1* | 12/2014 | Baba ..... | H01J 49/4255<br>250/283 |
| 2017/0352530 | A1* | 12/2017 | Belov ..... | H01J 49/4295 |

* cited by examiner

Auxiliary electrode

FOURIER TRANSFORM MASS SPECTROMETER BASED ON USE OF A FRINGING FIELD TO CONVERT RADIAL OSCILLATIONS OF EXCITED IONS TO AXIAL OSCILLATIONS

RELATED APPLICATION

This application claims priority to U.S. provisional application No. 62/453,167 filed on Feb. 1, 2017, entitled "Fourier Transform Mass Spectrometer," which is incorporated herein by reference in its entirety.

BACKGROUND

The present invention relates generally to a mass analyzer, and in particular to a Fourier transform mass analyzer, which can be employed in a variety of different mass spectrometers.

Mass spectroscopy (MS) is an analytical technique for determining the elemental composition of test substances with both quantitative and qualitative applications. For example, MS can be used to identify unknown compounds, to determine the isotopic composition of elements in a molecule, and to determine the structure of a particular compound by observing its fragmentation, as well as to quantify the amount of a particular compound in the sample. In some cases, low resolution mass spectra may be sufficient to identify analytes of interest following upstream chromatographic separation.

There is still a need for improved scanning mass spectrometers with suitable sensitivity, which can be used in combination with chromatographic separation.

SUMMARY

In one aspect, a mass analyzer is disclosed, which comprises a quadrupole having an input end for receiving ions and an output end through which ions can exit the quadrupole, said quadrupole having a plurality of rods to at least some of which an RF voltage can be applied for generating a quadrupolar field for causing radial confinement of the ions as they propagate through the quadrupole and further generating fringing fields in proximity of said output end. The mass analyzer further includes at least a voltage source for applying a voltage pulse to at least one of said rods so as to excite radial oscillations of at least a portion of the ions passing through the quadrupole at secular frequencies thereof, where at least a portion of the radially-excited ions interact with the fringing fields as they exit the quadrupole such that their radial oscillations are converted into axial oscillations.

The mass analyzer can further include a detector disposed downstream of the output end of the quadrupole for detecting said axially oscillating ions exiting the quadrupole. The detector generates a time-varying signal in response to detection of at least a portion of the axially oscillating ions. An analyzer can receive the time-varying signal from the detector and can apply a Fourier transform to the time-varying signal to generate a frequency domain signal. The analyzer can further operate on the frequency domain signal to generate a mass spectrum of the detected ions.

The amplitude and the duration of the voltage pulse can be selected, e.g., based on a particular application. By way of example, the voltage pulse can have a duration in a range of about 10 nanoseconds (ns) to about 1 millisecond, e.g., in a range of about 1 microsecond to about 100 microseconds, or in a range of about 5 microseconds to about 50 microseconds, or in a range of about 10 microseconds to about 30 microseconds. Further, the voltage pulse can have an amplitude, for example, in a range of about 10 volts to about 40 volts. For example, the amplitude of the voltage pulse can be in a range of about 20 volts to 30 volts. In some embodiments, the voltage pulse is applied as a dipolar voltage, i.e., via application of a positive voltage to one rod and a negative voltage to another (typically, a diagonally opposed rod). In other embodiments, the voltage pulse may be applied to a single rod.

In some embodiments, the quadrupole is maintained at a pressure in a range of about $1\times10^{-6}$ Torr to about $1.5\times10^{-3}$ Torr. For example, the quadrupole can be maintained at a pressure in a range of about $8\times10^{-6}$ Torr to about $1\times10^{-4}$ Torr. In some embodiments, the quadrupole is maintained at a pressure in a range of about $1\times10^{-6}$ Torr to about $9\times10^{-3}$ Torr.

The quadrupole can include four rods (herein referred to as the quadrupole rods) that are arranged so as to provide a pathway therebetween for the passage of ions therethrough. The application of one or more RF voltages to one or more of the quadrupole rods can generate a quadrupolar field, which can facilitate the radial confinement of the ions as they pass through the quadrupole. In some embodiments, the quadrupole includes a plurality of auxiliary electrodes, e.g., four auxiliary electrodes interspersed between the quadrupole rods. In some such embodiments, the voltage pulse is applied to at least one of the auxiliary electrodes. For example, a dipolar voltage pulse can be applied to two diagonally opposed auxiliary electrodes.

In some embodiments, the mass analyzer can include an input lens and/or an output lens. The analyzer can include a DC voltage source for applying a DC voltage to any of the input lens and/or the output lens. The input lens can be positioned in proximity of the input end of the quadrupole to facilitate the entry of ions into the quadrupole and the exit lens can be positioned in proximity of the output end of the quadrupole to facilitate the exit of the ions from the quadrupole. In some embodiments, an attractive DC voltage can be applied to the exit lens, e.g., a DC voltage in a range of about −5 to −50 V attractive relative to the quadrupole DC offset, to adjust the fringing fields in proximity of the output end of the quadrupole. In some embodiments, the analyzer can comprise an RF voltage source for applying an RF voltage to any of the input lens and/or output lens. In some embodiments, an RF voltage can be applied to the exit lens, e.g., an RF voltage in a range of about 10 $V_{p\text{-}p}$ to 300 $V_{p\text{-}p}$, with frequency in the range of 50 kHz to 2 MHz, to adjust the fringing fields in proximity of the output end of the quadrupole.

A mass analyzer according to the present teachings can be incorporated in a variety of different mass spectrometers. For example, such a mass spectrometer can include a mass analyzer according to the present teachings, an ion source for generate ions and elements for focusing, guiding, selecting and/or dissociating ions disposed, e.g., upstream of the mass analyzer. By way of example, an ion-focusing quadrupole can be disposed between an ion source and a mass analyzer according to the present teachings. In some embodiments, a collision cell can be disposed between the ion source and the quadrupole. The collision cell can receive ions from the ion source and cause the fragmentation of at least a portion of the received ions to generate fragmented ions, wherein at least a portion of the fragmented ions are received by the quadrupole.

In a related aspect, a method of performing mass analysis is disclosed, which comprises passing a plurality of ions through a quadrupole comprising a plurality of rods, said quadrupole having an input end for receiving the ions and an output end through which ions exit the quadrupole, and applying at least one RF voltage to at least one of the rods so as to generate an electromagnetic field for radial confinement of the ions as they pass through the quadrupole. The method can further include applying a voltage pulse across at least one pair of said plurality of rods so as to excite radial oscillations of at least a portion of the ions passing through the quadrupole at secular frequencies thereof, wherein the fringing fields in proximity to said output end can convert the radial oscillations of at least a portion of said excited ions into axial oscillations as the excited ions exit the quadrupole rod set.

The method can further include detecting at least a portion of the axially oscillating ions exiting the quadrupole rod set to generate a time-varying signal. A Fourier transform of the time-varying signal can be obtained so as to generate a frequency-domain signal. The frequency domain signal can then be used to generate a mass spectrum associated with the detected ions. In some embodiments, the kinetic energy of the ions entering the quadrupole is selected so as to obtain a temporal length of the time-varying signal corresponding to a desired resolution, where the resolution increases as the temporal length of the time-varying signal increases.

Further understanding of various aspects of the present teachings can be obtained by reference to the following detailed description in conjunction with the associated drawings, which are described briefly below.

DETAILED DESCRIPTION

The present teachings relate to a mass analyzer that can include a quadrupole rod set and optionally a plurality of auxiliary electrodes. The application of a voltage pulse to one or more the quadrupole rods or to one or more of the auxiliary electrodes can cause a radial excitation of at least a portion of the ions passing through the quadrupole. The interaction of the radially excited ions with the fringing fields in the vicinity of the output end of the quadrupole can convert radial oscillations of at least a portion of the excited ions into axial oscillations. The axially oscillating ions can be detected by a detector to generate an ion signal. A mass spectrum of the detected ions can be calculated based on the Fourier transform of the ion signal. The ions pass through the mass analyzer without being first trapped in the mass analyzer.

Various terms are used herein consistent with their common meanings in the art. The term "radial" is used herein to refer to a direction within a plane perpendicular to the axial dimension of the quadrupole rods set (e.g., along z-direction in FIG. 1A). The terms "radial excitation" and "radial oscillations" refer, respectively, to excitation and oscillations in a radial direction. The term "about" as used herein to modify a numerical value is intended to denote a variation of at most 5 percent about the numerical value.

Figure 1A:
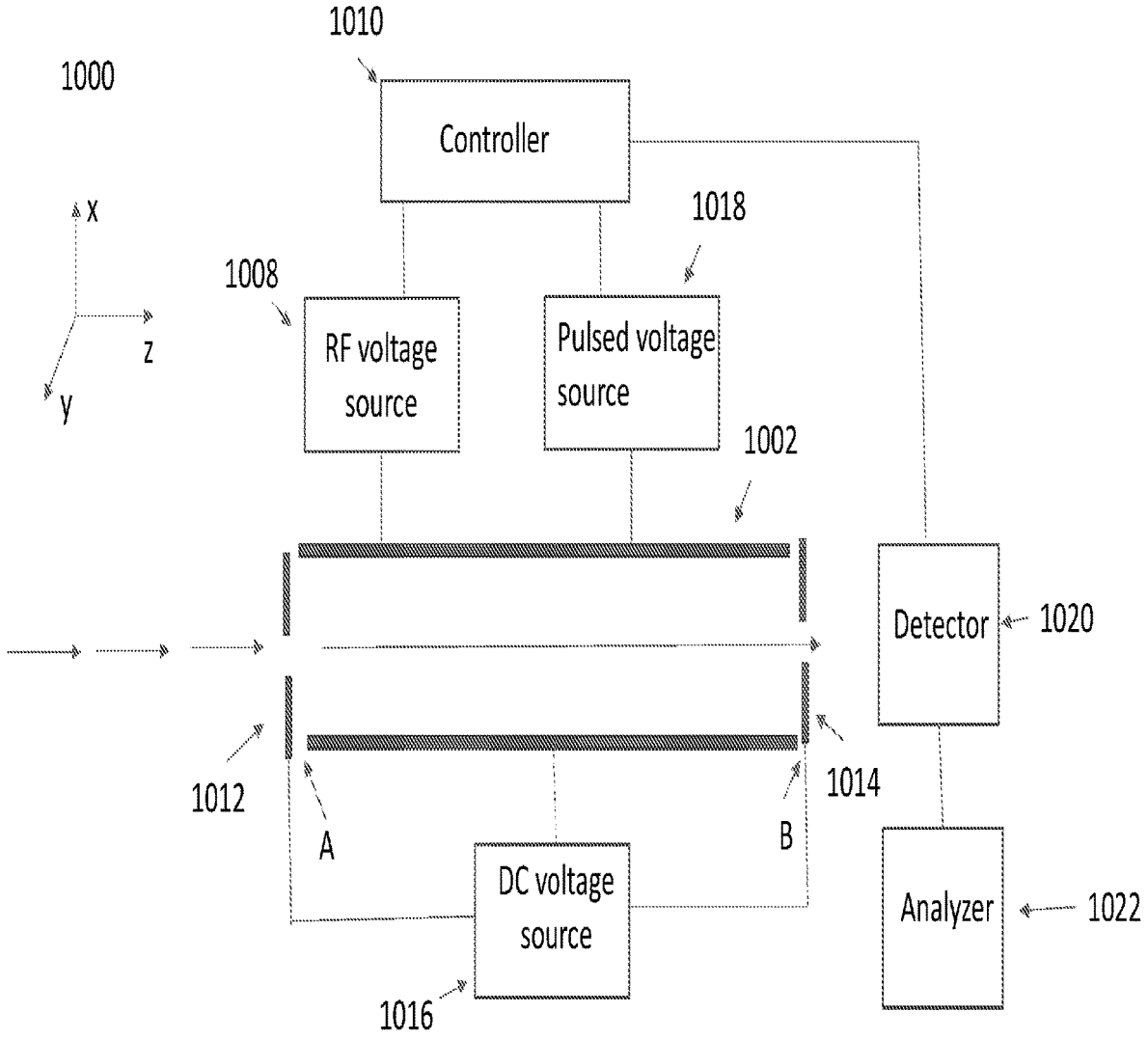
FIG. 1A schematically depicts a mass analyzer according to an embodiment of the present teachings.
Figure 1B:
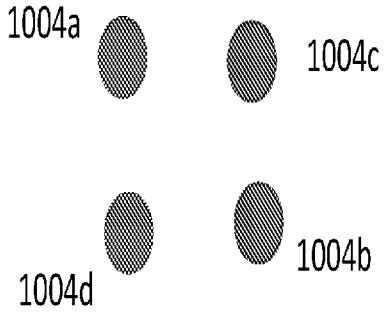
FIG. 1B is a schematic end view of the quadrupole rods of the mass analyzer depicted in FIG. 1A, FIG. 2 schematically depicts a square voltage pulse suitable for use in some embodiments of a mass analyzer according to the present teachings, FIG. 3 schematically depicts one exemplary implementation of an analysis module suitable for use in a mass analyzer according to the present teachings.

FIGS. 1A and 1B schematically depict a mass analyzer 1000 according to an embodiment of the present teachings, which includes a quadrupole rod set 1002 that extends from an input end (A) configured for receiving ions to an output end (B) through which ions can exit the quadrupole rod set. In this embodiment, the quadrupole rod set includes four rods 1004*a*, 1004*b*, 1004*c*, and 1004*d* (herein collectively referred to as quadrupole rods 1004), which are arranged relative to one another to provide a passageway therebetween through which ions received by the quadrupole rod set can propagate from the input end (A) to the output end (B). In this embodiment, the quadrupole rods 1004 have a circular cross-section while in other embodiments they can have a different cross-sectional shape, such as hyperbolic.

The mass analyzer 1000 can receive ions, e.g., a continuous stream of ions, generated by an ion source (not shown in this figure). A variety of different types of ion sources can be employed. Some suitable examples include, without limitation, an electrospray ionization device, a nebulizer assisted electrospray device, a chemical ionization device, a nebulizer assisted atomization device, a matrix-assisted laser desorption/ionization (MALDI) ion source, a photoionization device, a laser ionization device, a thermospray ionization device, an inductively coupled plasma (ICP) ion source, a sonic spray ionization device, a glow discharge ion source, and an electron impact ion source, DESI, among others.

The application of radiofrequency (RF) voltages to the quadrupole rods 1004 can provide a quadrupolar field for radial confinement of the ions as they pass through the quadrupole. The RF voltages can be applied to the rods with or without a selectable amount of a resolving DC voltage applied concurrently to one or more of the quadrupole rods.

In some embodiments, the RF voltages applied to the quadrupole rods 1004 can have a frequency in a range of about 0.8 MHz to about 3 MHz and an amplitude in a range of about 100 volts to about 1500 volts, though other frequencies and amplitudes can also be employed. In this embodiment, an RF voltage source 1008 operating under the control of a controller 1010 provides the required RF voltages to the quadrupole rods 1004.

In some embodiments, the pressure within the quadrupole rod set can be maintained in a range of about $1\times10^{-6}$ Torr to about $1.5\times10^{-3}$ Torr, e.g., in a range of about $8\times10^{-6}$ Torr to about $5\times10^{-4}$ Torr. In some embodiments, the quadrupole is maintained at a pressure in a range of about $1\times10^{-6}$ Torr to about $9\times10^{-3}$ Torr.

The application of the RF voltage(s) can result in the generation of a quadrupolar field within the quadrupole characterized by fringing fields in the vicinity of the input (entrance) and the exit ends of the quadrupole rod set. As discussed in more detail below such fringing fields can couple the radial and axial motions of the ions. By way of example, the diminution of the quadrupole potential in the regions in the proximity of the output end (B) of the quadrupole rod set can result in the generation of fringing fields, which can exhibit a component along the longitudinal direction of the quadrupole (along the z-direction). In some embodiments, the amplitude of this electric field can increase as a function of increasing radial distance from the center of the quadrupole rod set.

By way of illustration and without being limited to any particular theory, the application of the RF voltage(s) to the quadrupole rods can result in the generation of a two-dimensional quadrupole potential as defined in the following relation:

$$\varphi_{2D} = \varphi_0 \frac{x^2 - y^2}{r_0^2} \quad \text{Eq. (1)}$$

where, $\varphi_0$ represents the electric potential measured with respect to the ground, and x and y represent the Cartesian coordinates defining a plane perpendicular to the direction of the propagation of the ions (i.e., perpendicular to the z-direction). The electromagnetic field generated by the above potential can be calculated by obtaining a spatial gradient of the potential.

Again without being limited to any particular theory, to a first approximation, the potential associated with the fringing fields in the vicinity of the input and the output ends of the quadrupole may be characterized by the diminution of the two-dimensional quadrupole potential in the vicinity of the input and the output ends of the quadrupole by a function $f(z)$ as indicated below:

$$\varphi_{FF}=\varphi_{2D}f(z) \quad \text{Eq. (2)}$$

where, $\varphi_{FF}$ denotes the potential associated with the fringing fields and $\varphi_{2D}$ represents the two-dimensional quadrupole potential discussed above. The axial component of the fringing electric field ($E_{z,quad}$) due to the diminution of the two-dimensional quadrupole field can be described as follow:

$$E_{z,quad} = -\varphi_{2D} \frac{\partial f(z)}{\partial z} \quad \text{Eq. (3)}$$

As discussed in more detail below, such a fringing field allows converting radial oscillations of ions excited via application of a voltage pulse to one or more of the quadrupole rods (and/or one or more auxiliary electrodes) to axial oscillations, where the axially oscillating ions are detected by a detector.

With continued reference to FIGS. 1A and 1B, in this embodiment, the mass analyzer 1000 further includes an input lens 1012 disposed in proximity of the input end of the quadrupole rod set and an output lens 1014 disposed in proximity of the output end of the quadrupole rod set. A DC voltage source 1016, operating under the control of the controller 1010, can apply two DC voltages, e.g., in range of about 1 to 50 V attractive relative to the DC offset of the quadrupole, to the input lens 1012 and the output lens 1014. In some embodiments, the DC voltage applied to the input lens 1012 causes the generation of an electric field that facilitates the entry of the ions into the mass analyzer. Further, the application of a DC voltage to the output lens 1014 can facilitate the exit of the ions from the quadrupole rod set.

The lenses 1012 and 1014 can be implemented in a variety of different ways. For example, in some embodiments, the lenses 1012 and 1014 can be in the form of a plate having an opening through which the ions pass. In other embodiments, at least one (or both) of the lenses 1012 and 1014 can be implemented as a mesh. There can also be RF-only Brubaker lenses at the entrance and exit ends of the quadrupole.

In some embodiments, the DC voltage source can apply a resolving DC voltage to one or more of the quadrupole rods so as to select ions within a desired m/z window. In some embodiments, such a resolving DC voltage can be in a range of about 10 to about 150 V.

With continued reference to FIGS. 1A and 1B, the analyzer 1000 further includes a pulsed voltage source 1018 for applying a pulsed voltage to at least one of the quadrupole rods 1004. In this embodiment, the pulsed voltage source 1018 applies a dipolar pulsed voltage to the rods 1004*a* and 1004*b*, though in other embodiments, the dipolar pulsed voltage can be applied to the rods 1004*c* and 1004*d*.

In some embodiments, the amplitude of the applied pulsed voltage can be, for example, in a range of about 10 volts to about 40 volts, or in a range of about 20 volts to about 30 volts, though other amplitudes can also be used. Further, the duration of the pulsed voltage (pulse width) can be, for example, in a range of about 10 nanoseconds (ns) to about 1 millisecond, e.g., in a range of about 1 microsecond to about 100 microseconds, or in a range of about 5 microseconds to about 50 microseconds, or in a range of about 10 microseconds to about 40 microseconds, though other pulse durations can also be used. In general, a variety of pulse amplitudes and durations can be employed. In many embodiments, the longer is the pulse width, the smaller is the pulse amplitude. Ions passing through the quadrupole are normally exposed to only a single excitation pulse. Once the "slug" of excited ions pass through the quadrupole, an additional excitation pulse is triggered. This normally occurs every 1 to 2 ms, so that about 500 to 1000 data acquisition periods are collected each second.

Figure 2:
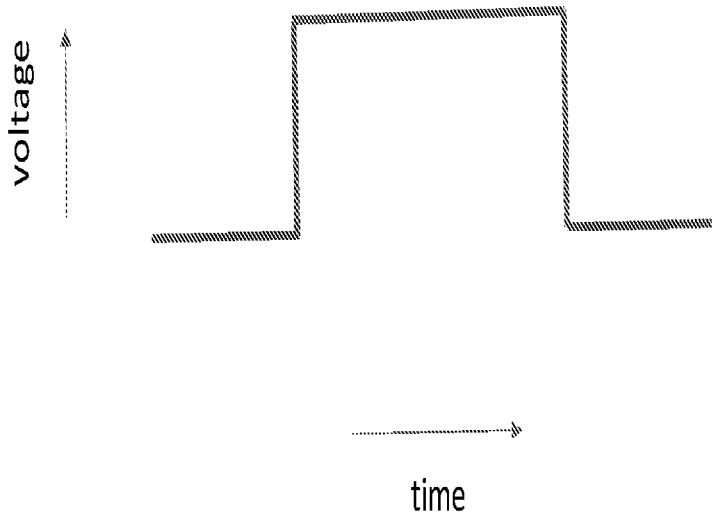

The waveform associated with the voltage pulse can have a variety of different shapes with the goal of providing a rapid broadband excitation signal. By way of example, FIG. 2 schematically shows an exemplary voltage pulse having a square temporal shape. In some embodiments, the rise time of the voltage pulse, i.e., the time duration that it takes for the voltage pulse to increase from zero voltage to reach its maximum value, can be, for example, in a range of about 1 to 100 nsec. In other embodiments, the voltage pulse can have a different temporal shape.

Without being limited to any particular theory, the application of the voltage pulse, e.g., across two diagonally opposed quadrupole rods, generates a transient electric field within the quadrupole. The exposure of the ions within the quadrupole to this transient electric field can radially excite at least some of those ions at their secular frequencies. Such excitation can encompass ions having different mass-to-charge (m/z) ratios. In other words, the use of an excitation voltage pulse having a short temporal duration can provide a broadband radial excitation of the ions within the quadrupole.

As the radially excited ions reach the end portion of the quadrupole rod set in the vicinity of the output end (B), they will interact with the exit fringing fields. Again, without being limited to any particular theory, such an interaction can convert the radial oscillations of at least a portion of the excited ions into axial oscillations.

Referring again to FIGS. 1A and 1B, the axially oscillating ions leave the quadrupole rod set and the exit lens 1014 to reach a detector 1020, which operates under the control of the controller 1010. The detector 1020 generates a time-varying ion signal in response to the detection of the axially oscillating ions. A variety of detectors can be employed. Some examples of suitable detectors include, without limitation, are Photonis Channeltron Model 4822C and ETP electron multiplier Model AF610.

An analyzer 1022 (herein also referred to as an analysis module) in communication with the detector 1020 can receive the detected time-varying signal and operate on that signal to generate a mass spectrum associated with the detected ions. More specifically, in this embodiment, the analyzer 1022 can obtain a Fourier transform of the detected time-varying signal to generate a frequency-domain signal. The analyzer can then convert the frequency domain signal into a mass spectrum using the relationships between the Mathieu a- and q-parameters and m/z.

$$a_x = -a_y = \frac{8zU}{\Omega^2 r_0^2 m} \quad \text{Eq. (4)}$$

$$q_x = -q_y = \frac{4zV}{\Omega^2 r_0^2 m} \quad \text{Eq. (5)}$$

where z is the charge on the ion, U is the DC voltage on the rods, V is the RF voltage amplitude, Ω is the angular frequency of the RF, and $r_0$ is the characteristic dimension of the quadrupole. The radial coordinate r is given by $$r^2 = x^2 + y^2 \quad \text{Eq. (6)}$$

In addition, when q<~0.4 the parameter β is given by the $$\beta^2 = a + \frac{q^2}{2} \quad \text{Eq. (7)}$$

and the fundamental secular frequency is given by $$\omega = \frac{\beta\Omega}{2} \quad \text{Eq. (8)}$$

Under the condition where a=0 and q<~0.4, the secular frequency is related to m/z by the approximate relationship below.

$$\frac{m}{z} \sim \frac{2}{\sqrt{2}} \frac{V}{\omega\Omega r_0^2} \quad \text{Eq. (9)}$$

The exact value of β is a continuing fraction expression in terms of the a- and q-Mathieu parameters. This continuing fraction expression can be found in the reference J. Mass Spectrom. Vol 32, 351-369 (1997), which is herein incorporated by reference in its entirety.

The relationship between m/z and secular frequency can alternatively be determined through fitting a set of frequencies to the equation $$\frac{m}{z} = \frac{A}{\omega} + B \quad \text{Eq. (10)}$$

where, A and B are constants to be determined.

In some embodiments, a mass analyzer according to the present teachings can be employed to generate mass spectra with a resolution that depends on the length of the time varying excited ion signal, but the resolution can be typically in a range of about 100 to about 1000.

Figure 3:
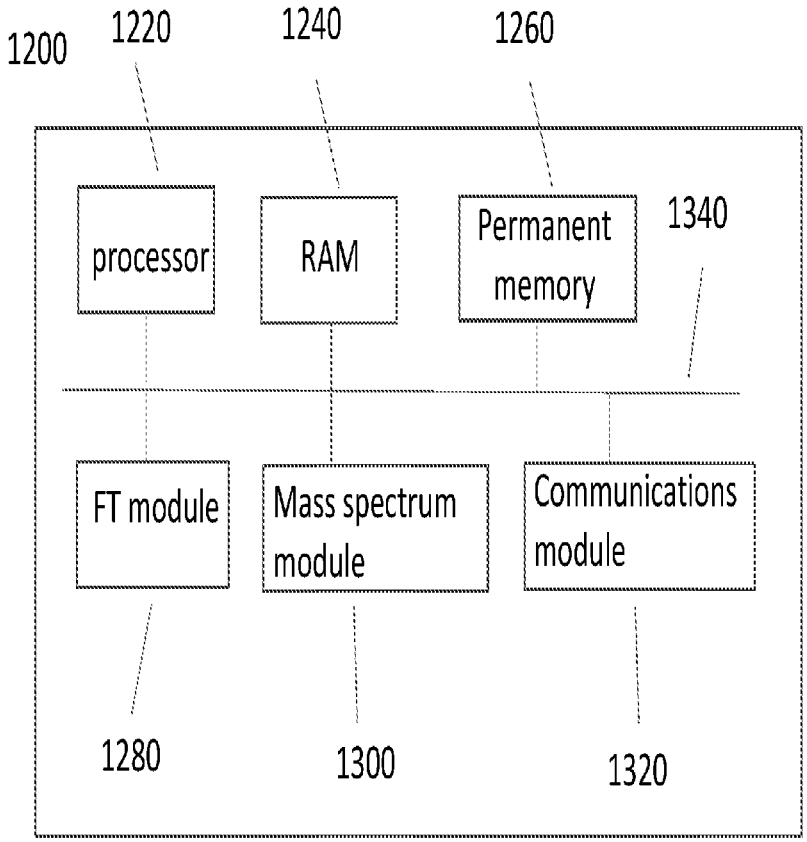

The analyzer 1022 can be implemented in hardware and/or software in a variety of different ways. By way of example, FIG. 3 schematically depicts an embodiment of the analyzer 1200, which includes a processor 1220 for controlling the operation of the analyzer. The exemplary analyzer 1200 further includes a random-access memory (RAM) 1240 and a permanent memory 1260 for storing instructions and data. The analyzer 1200 also includes a Fourier transform (FT) module 1280 for operating on the time-varying ion signal received from the detector 1180 (e.g., via Fourier transform) to generate a frequency domain signal, and a module 1300 for calculating the mass spectrum of the detected ions based on the frequency domain signal. A communications module 1320 allows the analyzer to communicate with the detector 1180, e.g., to receive the detected ion signal. A communications bus 1340 allows various components of the analyzer to communicate with one another.

Figure 4A:
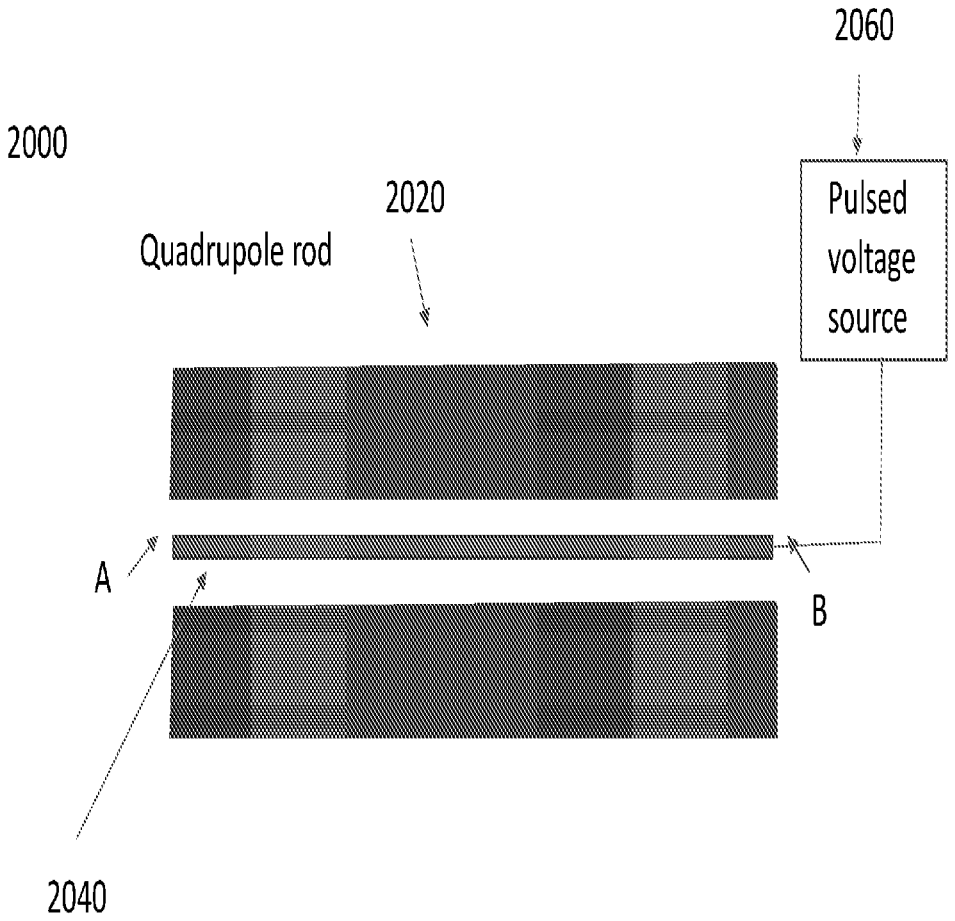
FIG. 4A is a side schematic view of a mass analyzer according to an embodiment, where the analyzer include a four quadrupole rods and four auxiliary electrodes.
Figure 4B:
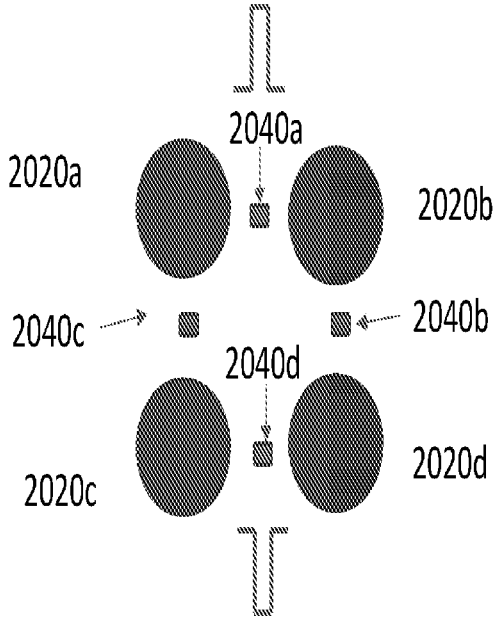
FIG. 4B is an end view of the mass analyzer depicted in FIG. 4A.

In some embodiments, a mass analyzer according to the present teachings can include a quadrupole rod set as well as one or more auxiliary electrodes to which a voltage pulse can be applied for radial excitation of the ions within the quadrupole. By way of example, FIGS. 4A and 4B schematically depict a mass analyzer 2000 according to such an embodiment, which includes a quadrupole rod set 2020 composed of four rods 2020*a*, 2020*b*, 2020*c*, and 202*d* (herein collectively referred to as quadrupole rods 2020). In this embodiment, the analyzer 2000 further includes a plurality of auxiliary electrodes 2040*a*, 2040*b*, 2040*c* and 2040*d* (herein collectively referred to as auxiliary electrodes 2040), which are interspersed between the quadrupole rods 2020. Similar to the quadrupole rods 2020, the auxiliary electrodes 2040 extend from an input end (A) of the quadrupole to an output end (B) thereof. In this embodiment, the auxiliary electrodes 2040 have substantially similar lengths as the quadrupole rods 2020, though in other embodiments they can have different lengths.

Similar to the previous embodiment, RF voltages can be applied to the quadrupole rods 2020, e.g., via an RF voltage source (not shown) for radial confinement of the ions passing therethrough. Rather than applying a voltage pulse to one or more of the quadrupole rods, in this embodiment, a voltage pulse can be applied to one or more of the auxiliary electrodes to cause radial excitation of at least some of the ions passing through the quadrupole. By way of example, in this embodiment, a pulsed voltage source 2060 can apply a dipolar voltage pulse to the rods 2040*a* and 2040*d* (e.g., a positive voltage to the rod 2040*a* and a negative voltage to the rod 2040*d*).

Similar to the previous embodiment, the voltage pulse can cause radial excitation of at least some of the ions passing through the quadrupole. As discussed above, the interaction of the radially excited ions with the fringing fields in proximity of the output end of the quadrupole can convert the radial oscillations to axial oscillations, and the axially oscillating ions can be detected by a detector (not shown in this figure). Similar to the previous embodiment, an analyzer, such as the analyzer 1200 discussed above, can operate on a time-varying ion signal generated as a result of the detection of the axially oscillating ions to generate a frequency domain signal and can operate on the frequency domain signal to generate a mass spectrum of the detected ions.

Figure 5:
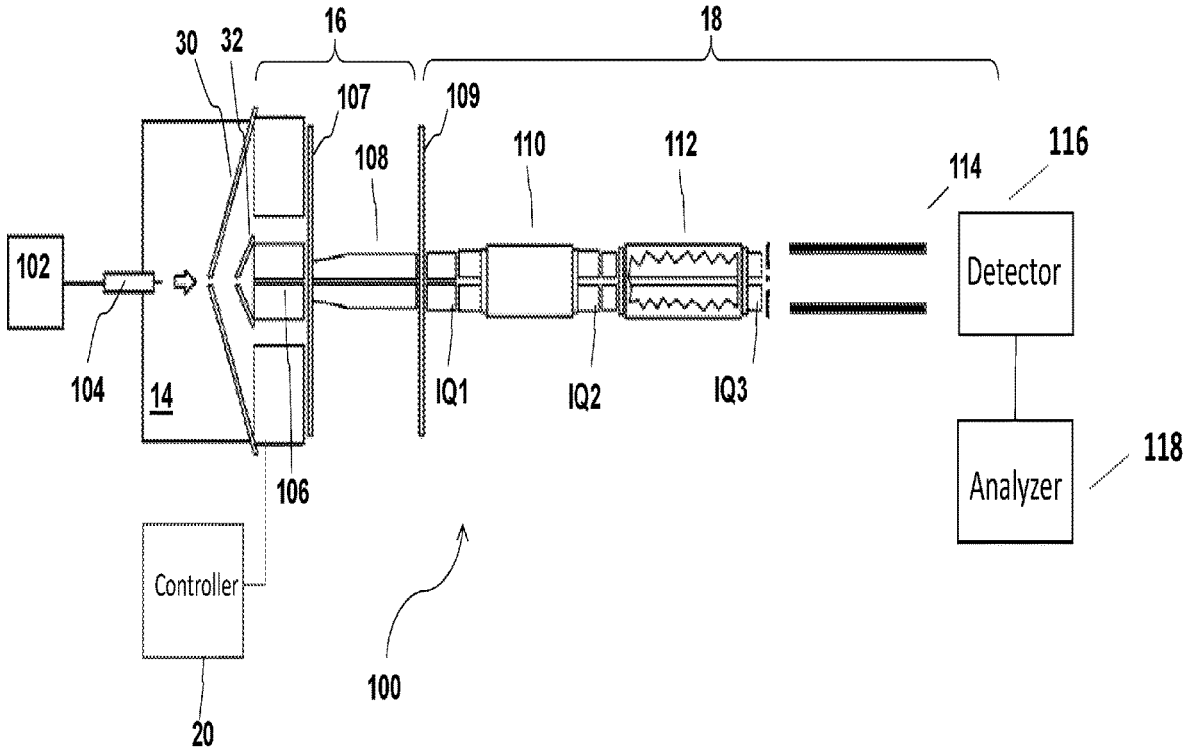
FIG. 5 is a schematic view of a mass spectrometer in which a mass analyzer according to the present teachings is incorporated.

A mass analyzer according to the present teachings can be incorporated in a variety of different mass spectrometers. By way of example, FIG. 5 schematically depicts such a mass spectrometer 100, which comprises an ion source 104 for generating ions within an ionization chamber 14, an upstream section 16 for initial processing of ions received therefrom, and a downstream section 18 containing one or more mass analyzers, collision cell and a mass analyzer 116 according to the present teachings.

Ions generated by the ion source 104 can be successively transmitted through the elements of the upstream section 16 (e.g., curtain plate 30, orifice plate 32, QJet 106, and Q0 108) to result in a narrow and highly focused ion beam (e.g., in the z-direction along the central longitudinal axis) for further mass analysis within the high vacuum downstream portion 18. In the depicted embodiment, the ionization chamber 14 can be maintained at an atmospheric pressure, though in some embodiments, the ionization chamber 14 can be evacuated to a pressure lower than atmospheric pressure. The curtain chamber (i.e., the space between curtain plate 30 and orifice plate 32) can also be maintained at an elevated pressure (e.g., about atmospheric pressure, a pressure greater than the upstream section 16), while the upstream section 16, and downstream section 18 can be maintained at one or more selected pressures (e.g., the same or different sub-atmospheric pressures, a pressure lower than the ionization chamber) by evacuation through one or more vacuum pump ports (not shown). The upstream section 16 of the mass spectrometer system 100 is typically maintained at one or more elevated pressures relative to the various pressure regions of the downstream section 18, which typically operate at reduced pressures so as to promote tight focusing and control of ion movement.

The ionization chamber 14, within which analytes contained within the fluid sample discharged from the ion source 104 can be ionized, is separated from a gas curtain chamber by a curtain plate 30 defining a curtain plate aperture in fluid communication with the upstream section via the sampling orifice of an orifice plate 32. In accordance with various aspects of the present teachings, a curtain gas supply can provide a curtain gas flow (e.g., of $N_2$) between the curtain plate 30 and orifice plate 32 to aid in keeping the downstream section of the mass spectrometer system clean by declustering and evacuating large neutral particles. By way of example, a portion of the curtain gas can flow out of the curtain plate aperture into the ionization chamber 14, thereby preventing the entry of droplets through the curtain plate aperture.

As discussed in detail below, the mass spectrometer system 100 also includes a power supply and controller (not shown) that can be coupled to the various components so as to operate the mass spectrometer system 100 in accordance with various aspects of the present teachings.

As shown, the depicted system 100 includes a sample source 102 configured to provide a fluid sample to the ion source 104. The sample source 102 can be any suitable sample inlet system known to one of skill in the art and can be configured to contain and/or introduce a sample (e.g., a liquid sample containing or suspected of containing an analyte of interest) to the ion source 104. The sample source 102 can be fluidly coupled to the ion source so as to transmit a liquid sample to the ion source 102 (e.g., through one or more conduits, channels, tubing, pipes, capillary tubes, etc.) from a reservoir of the sample to be analyzed, from an in-line liquid chromatography (LC) column, from a capillary electrophoresis (CE) instrument, or an input port through which the sample can be injected, all by way of non-limiting examples. In some aspects, the sample source 102 can comprise an infusion pump (e.g., a syringe or LC pump) for continuously flowing a liquid carrier to the ion source 104, while a plug of sample can be intermittently injected into the liquid carrier.

The ion source 104 can have a variety of configurations but is generally configured to generate ions from analytes contained within a sample (e.g., a fluid sample that is received from the sample source 102). In this embodiment, the ion source 104 comprises an electrospray electrode, which can comprise a capillary fluidly coupled to the sample source 102 and which terminates in an outlet end that at least partially extends into the ionization chamber 14 to discharge the liquid sample therein. As will be appreciated by a person skilled in the art in light of the present teachings, the outlet end of the electrospray electrode can atomize, aerosolize, nebulize, or otherwise discharge (e.g., spray with a nozzle) the liquid sample into the ionization chamber 14 to form a sample plume comprising a plurality of micro-droplets generally directed toward (e.g., in the vicinity of) the curtain plate aperture. As is known in the art, analytes contained within the micro-droplets can be ionized (i.e., charged) by the ion source 104, for example, as the sample plume is generated. In some aspects, the outlet end of the electrospray electrode can be made of a conductive material and electrically coupled to a power supply (e.g., voltage source) operatively coupled to the controller 20 such that as fluid within the micro-droplets contained within the sample plume evaporate during desolvation in the ionization chamber 12, bare charged analyte ions or solvated ions are released and drawn toward and through the curtain plate aperture. In some alternative aspects, the discharge end of the sprayer can be non-conductive and spray charging can occur through a conductive union or junction to apply high voltage to the liquid stream (e.g., upstream of the capillary). Though the ion source 104 is generally described herein as an electrospray electrode, it should be appreciated that any number of different ionization techniques known in the art for ionizing analytes within a sample and modified in accordance with the present teachings can be utilized as the ion source 104. By way of non-limiting example, the ion source 104 can be an electrospray ionization device, a nebulizer assisted electrospray device, a chemical ionization device, a nebulizer assisted atomization device, a matrix-assisted laser desorption/ionization (MALDI) ion source, a photoionization device, a laser ionization device, a thermospray ionization device, an inductively coupled plasma (ICP) ion source, a sonic spray ionization device, a glow discharge ion source, and an electron impact ion source, DESI, among others. It will be appreciated that the ion source 102 can be disposed orthogonally relative to the curtain plate aperture and the ion path axis such that the plume discharged from the ion source 104 is also generally directed across the face of the curtain plate aperture such that liquid droplets and/or large neutral molecules that are not drawn into the curtain chamber can be removed from the ionization chamber 14 so as to prevent accumulation and/or recirculation of the potential contaminants within the ionization chamber. In various aspects, a nebulizer gas can also be provided (e.g., about the discharge end of the ion source 102) to prevent the accumulation of droplets on the sprayer tip and/or direct the sample plume in the direction of the curtain plate aperture.

In some embodiments, upon passing through the orifice plate 32, the ions can traverse one or more additional vacuum chambers and/or quadrupoles (e.g., a QJet® quadrupole) to provide additional focusing of and finer control over the ion beam using a combination of gas dynamics and radio frequency fields prior to being transmitted into the downstream high-vacuum section 18. In accordance with various aspects of the present teachings, it will also be appreciated that the exemplary ion guides described herein can be disposed in a variety of front-end locations of mass spectrometer systems. By way of non-limiting example, the ion guide 108 can serve in the conventional role of a QJet® ion guide (e.g., operated at a pressure of about 1-10 Torr), as a conventional Q0 focusing ion guide (e.g., operated at a pressure of about 3-15 mTorr) preceded by a QJet® ion guide, as a combined Q0 focusing ion guide and QJet® ion guide (e.g., operated at a pressure of about 3-15 mTorr), or as an intermediate device between a QJet ion guide and Q0 (e.g., operated at a pressure in the 100 s of mTorrs, at a pressure between a typical QJet® ion guide and a typical Q0 focusing ion guide).

As shown, the upstream section 16 of system 100 is separated from the curtain chamber via orifice plate 32 and generally comprises a first RF ion guide 106 (e.g., QJet® of SCIEX) and a second RF guide 108 (e.g., Q0). In some exemplary aspects, the first RF ion guide 106 can be used to capture and focus ions using a combination of gas dynamics and radio frequency fields. By way of example, ions can be transmitted through the sampling orifice, where a vacuum expansion occurs as a result of the pressure differential between the chambers on either side of the orifice plate 32. By way of non-limiting example, the pressure in the region of the first RF ion guide can be maintained at about 2.5 Torr pressure. The QJet 106 transfers ions received thereby to subsequent ion optics such as the Q0 RF ion guide 108 through the ion lens IQ0 107 disposed therebetween. The Q0 RF ion guide 108 transports ions through an intermediate pressure region (e.g., in a range of about 1 mTorr to about 10 mTorr) and delivers ions through the IQ1 lens 109 to the downstream section 18 of system 100.

The downstream section 18 of system 100 generally comprises a high vacuum chamber containing the one or more mass analyzers for further processing of the ions transmitted from the upstream section 16. As shown in FIG. 5, the exemplary downstream section 18 includes a mass analyzer 110 (e.g., elongated rod set Q1) and a second elongated rod set 112 (e.g., q2) that can be operated as a collision cell. The downstream section further includes a mass analyzer 114 according to the present teachings.

Mass analyzer 110 and collision cell 112 are separated by orifice plates IQ2, and collision cell 112 and the mass analyzer 114 are separated by orifice plate IQ3. For example, after being transmitted from 108 Q0 through the exit aperture of the lens 109 IQ1, ions can enter the adjacent quadrupole rod set 110 (Q1), which can be situated in a vacuum chamber that can be evacuated to a pressure that can be maintained at a value lower than that of chamber in which RF ion guide 107 is disposed.

By way of non-limiting example, the vacuum chamber containing Q1 can be maintained at a pressure less than about $1\times10^{-4}$ Torr (e.g., about $5\times10^{-5}$ Torr), though other pressures can be used for this or for other purposes. As will be appreciated by a person of skill in the art, the quadrupole rod set Q1 can be operated as a conventional transmission RF/DC quadrupole mass filter that can be operated to select an ion of interest and/or a range of ions of interest. By way of example, the quadrupole rod set Q1 can be provided with RF/DC voltages suitable for operation in a mass-resolving mode. As should be appreciated, taking the physical and electrical properties of Q1 into account, parameters for an applied RF and DC voltage can be selected so that Q1 establishes a transmission window of chosen m/z ratios, such that these ions can traverse Q1 largely unperturbed. Ions having m/z ratios falling outside the window, however, do not attain stable trajectories within the quadrupole and can be prevented from traversing the quadrupole rod set Q1. It should be appreciated that this mode of operation is but one possible mode of operation for Q1.

Ions passing through the quadrupole rod set Q1 can pass through the lens IQ2 and into the adjacent quadrupole rod set q2, which can be disposed in a pressurized compartment and can be configured to operate as a collision cell at a pressure approximately in the range of from about 1 mTorr to about 10 mTorr, though other pressures can be used for this or for other purposes. A suitable collision gas (e.g., nitrogen, argon, helium, etc.) can be provided by way of a gas inlet (not shown) to thermalize and/or fragment ions in the ion beam.

In this embodiment, the ions exiting the collision cell 112 can be received by the mass analyzer 114 according to the present teachings. As discussed above, the mass analyzer 114 can be implemented as a quadrupole mass analyzer with or without auxiliary electrodes. The application of RF voltages to the quadrupole rods (with or without a selectable resolving DC voltage) can provide radial confinement of the ions as they pass through the quadrupole and the application of a DC voltage pulse to one or more of the RF rods or the auxiliary electrodes can cause radial excitation of at least a portion (and preferably all) of the ions. As discussed above, the interaction of the radially excited ions with the fringing fields as they exit the quadrupole can convert the radial excitation of at least some of the ions into axial excitation. The ions are then detected by a detector 118, which generates a time-varying ion signal. An analyzer 120 in communication with the detector 118 can operate on the time-varying ion signal to derive a mass spectrum of the detected ions in a manner discussed above.

The following examples are provided for further elucidation of various aspects of the present teachings, and are not intended to necessarily provide the optimal ways of practicing the present teachings or the optimal results that can be obtained.

Examples

Figure 6:
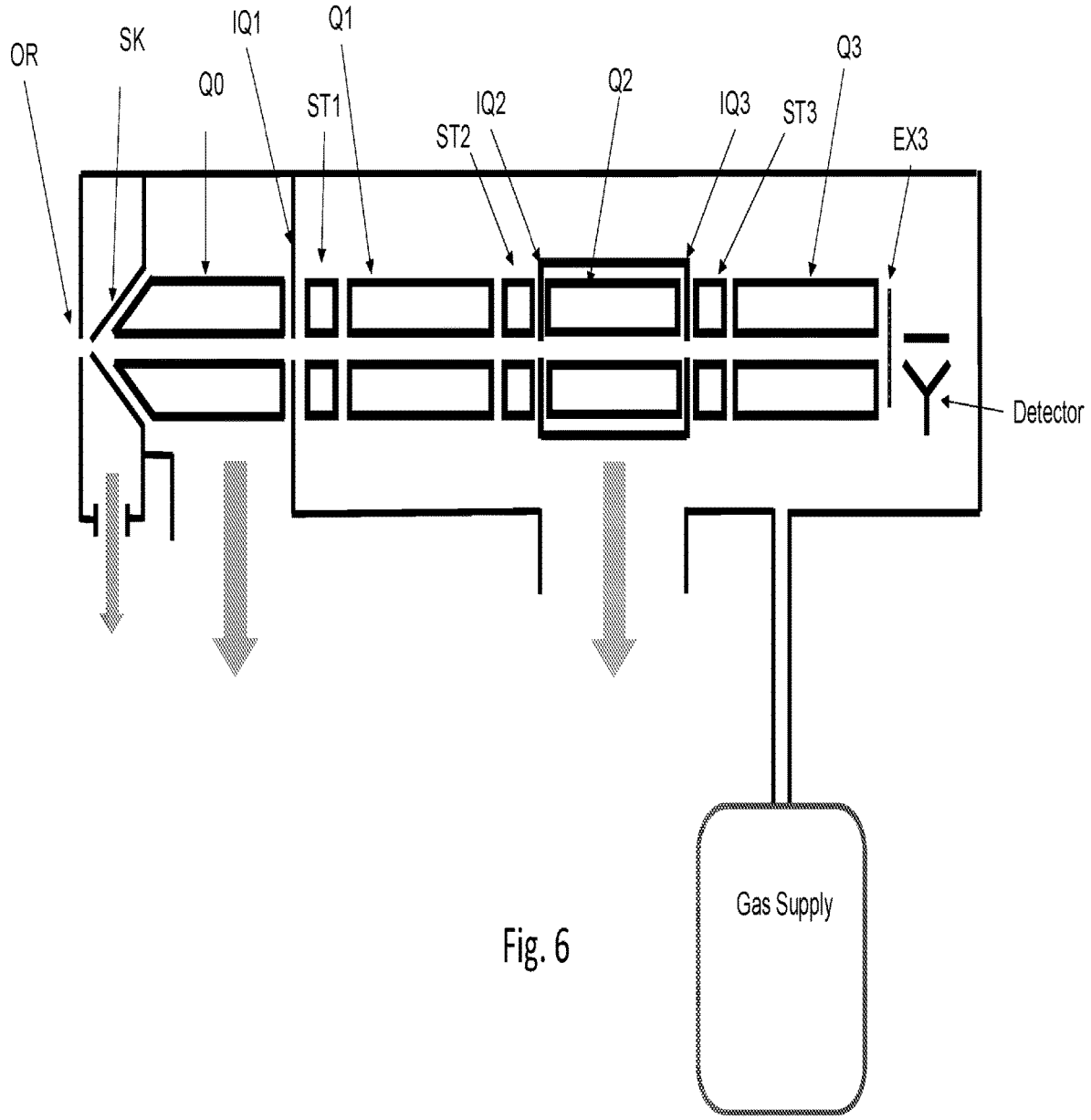
FIG. 6 is a schematic of an apparatus used to acquire illustrative data.

A 4000 QTRAP® (Sciex) mass spectrometer was modified to incorporate a mass analyzer according to the present teachings and is depicted schematically in FIG. 6. This system is very similar to the system described above, with the main exceptions being that the atmosphere-to-vacuum interface involves an orifice-skimmer configuration, rather than an orifice-QJet® configuration. Ions are generated by a nebulizer-assisted electrospray ion source (not shown) and travel through the orifice into an interface region at a pressure of approximately 2 Torr. From there the ions enter the Q0 collisional focusing region maintained at a pressure of about $8\times10^{-3}$ Torr. The ions are then directed into the main vacuum chamber containing the quadrupoles Q1, Q2, and Q3. The pressure of this chamber was nominally $8\times10^{-6}$ Torr, but it can be adjusted using an external gas supply. The enclosed Q2 collision cell contains nitrogen gas at a pressure of about $5\times10^{-3}$ Torr. Q1 can be used in RF-only mode to transport most ions emanating from the Q0 region downstream, or it can act as a quadrupole mass filter providing mass window selection. The RF frequencies of Q0, Q1, and Q2 were about 1 MHz. The Q3 RF frequency was 1.839 MHz. Excitation of ions as they pass through Q3 was provided by amplification of a square pulse generated by an Agilent 33220A function generator applied in a dipolar manner to two adjacent rods of the quadrupole. Normally, the positive and negative going sides of the dipolar pulse are about 20-40 V each after amplification.

Figure 7:
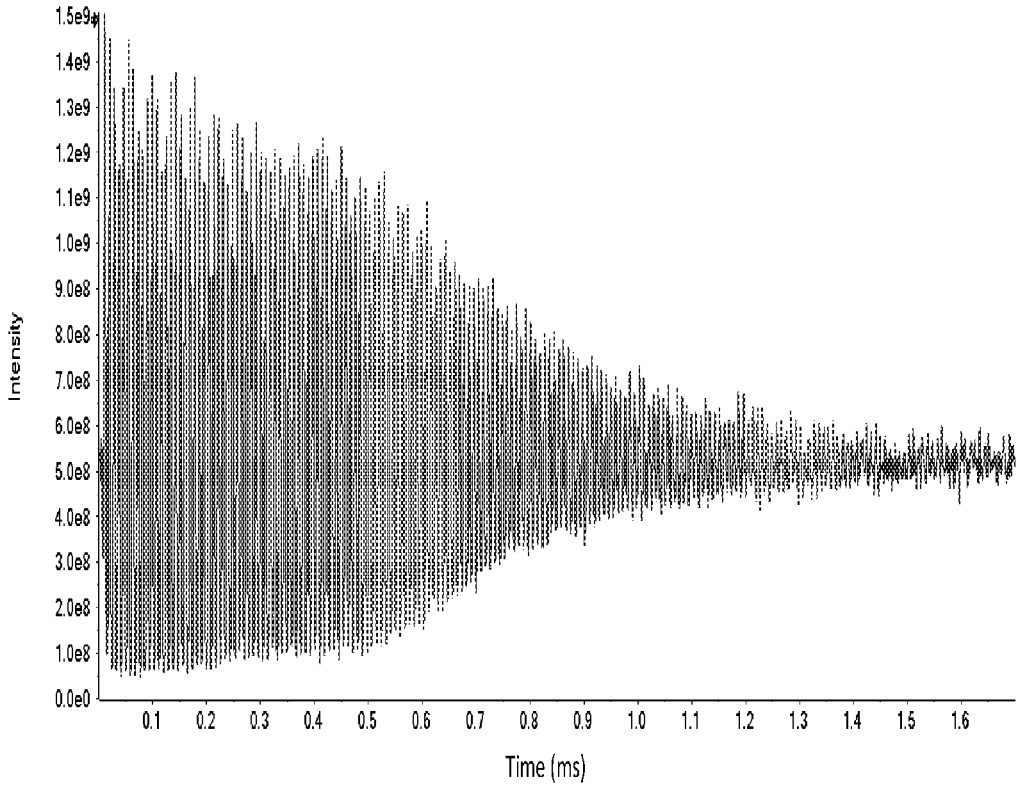
FIG. 7 shows a time-varying ion signal obtained using a prototype mass analyzer according to the present teachings.

An example of the oscillatory signal that results at the detector is shown in FIG. 7. This signal was generated following an excitation (750 ns, 30V) dipolar pulse of a Q1 mass-selected beam of m/z 609 from a 0.17 pmol/μL reserpine solution. The Q3 RF voltage was fixed at 640 V (0-peak), corresponding to a q-value of 0.174 for the m/z protonated molecular ion. The oscillatory signal lasts for approximately 1 ms. When this data file was put through a FFT program (DPlot Version 2.2.1.1, HydeSoft Computing, USA), the frequency spectrum shown in FIG. 8 results. The main peak is located at a frequency of 114.1 kHz, which is very close to the calculated secular frequency of 113.7 kHz calculated for an ion at m/z of 609.28 under the stated quadrupole conditions.

Figure 8:
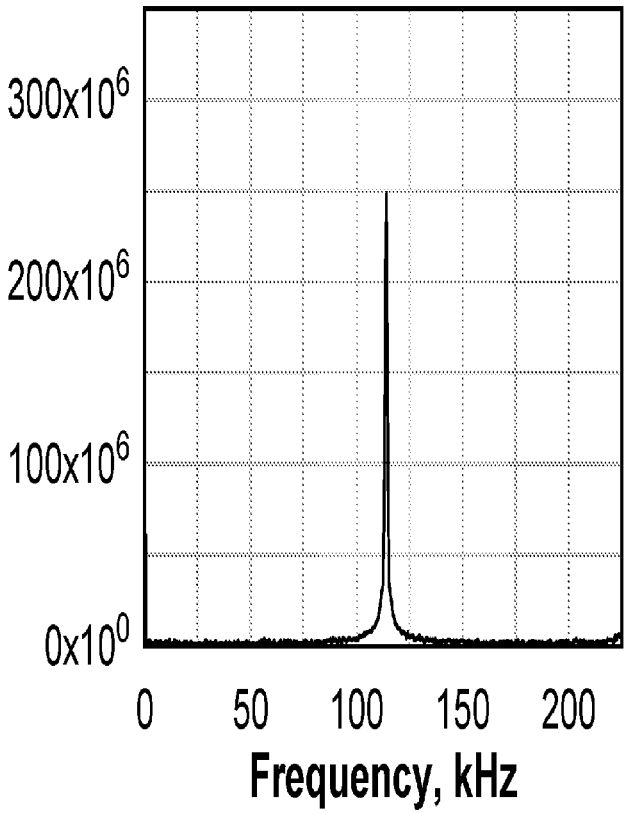
FIG. 8 is a Fourier transform of the oscillatory ion signal shown in FIG. 7, FIGS. 9A-9F present a series of oscillatory signals acquired at a variety of different ion energies entering a mass analyzer.
Figure 9:
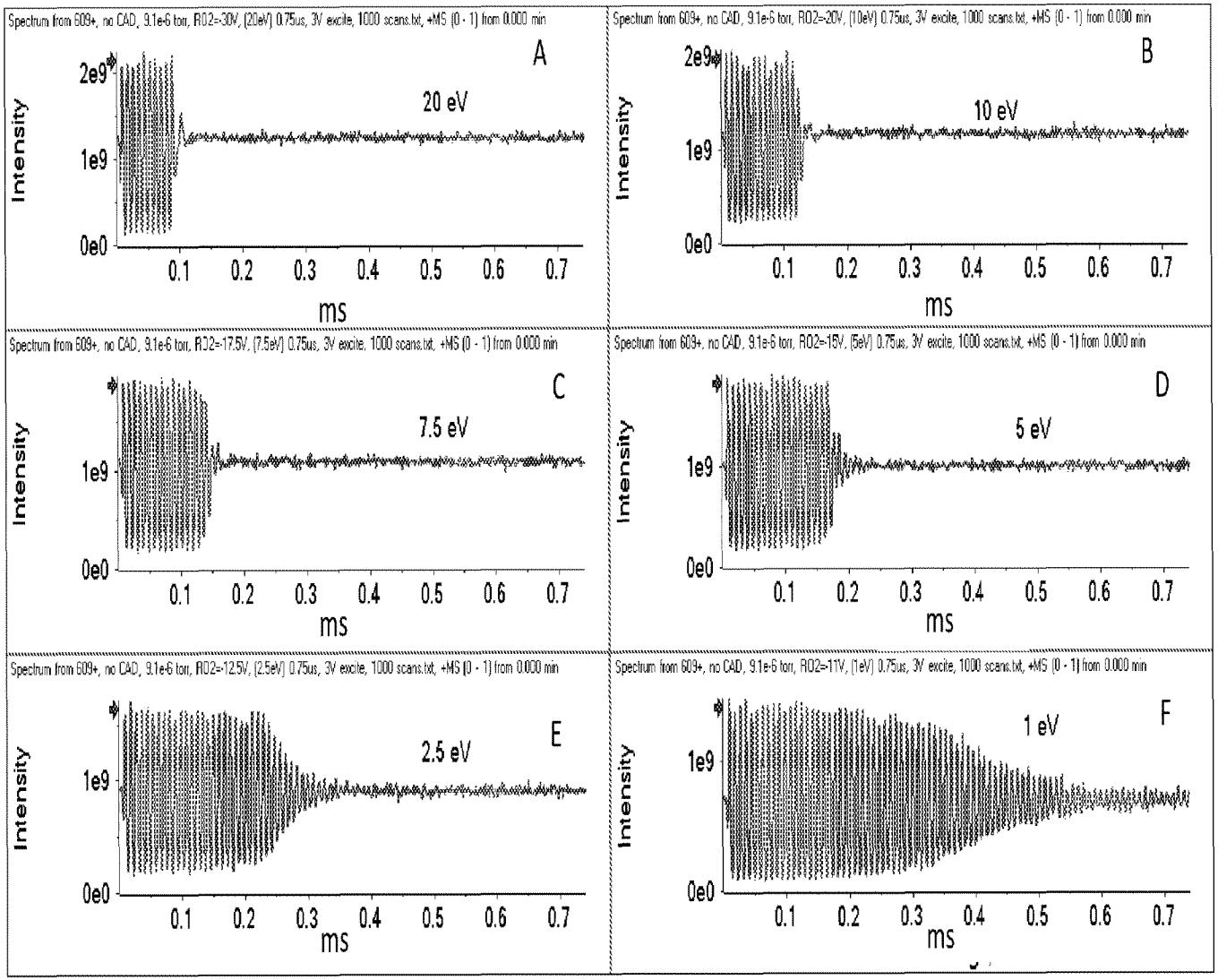

The length of the oscillatory signal gives an upper limit to mass spectral resolution. In this case the peak shown in FIG. 8 is 1.4 kHz wide, which yields a resolution of (114.1 kHz/1.4 kHz)=81.5. This is resolving power is not high, but is still useful for the separation of compounds in mixtures. The resolving power can be increased by increasing the length of the oscillatory signal, which is largely determined by the kinetic energy of ions passing through the quadrupole. FIGS. 9A-9F show the effect of ion kinetic energy on the length of the oscillatory signal following an excitation pulse. As the ion kinetic energy decreases the length of the oscillatory signal increases and resolution increases.

Since this analyzer works with a continuous ion beam, once the oscillatory signal has died away, another excitation pulse can be triggered and another oscillatory signal acquired. For signals that last about 1 ms, approximately 1000 such traces can be acquired, or rather, data can be acquired at a 1 kHz acquisition rate. Since all the ions passing through the quadrupole are excited and detected this mass analyzer records a full mass spectrum for every excitation pulse so very few ions are wasted. Thus, this analyzer is both rapid and sensitive.

Figure 10:
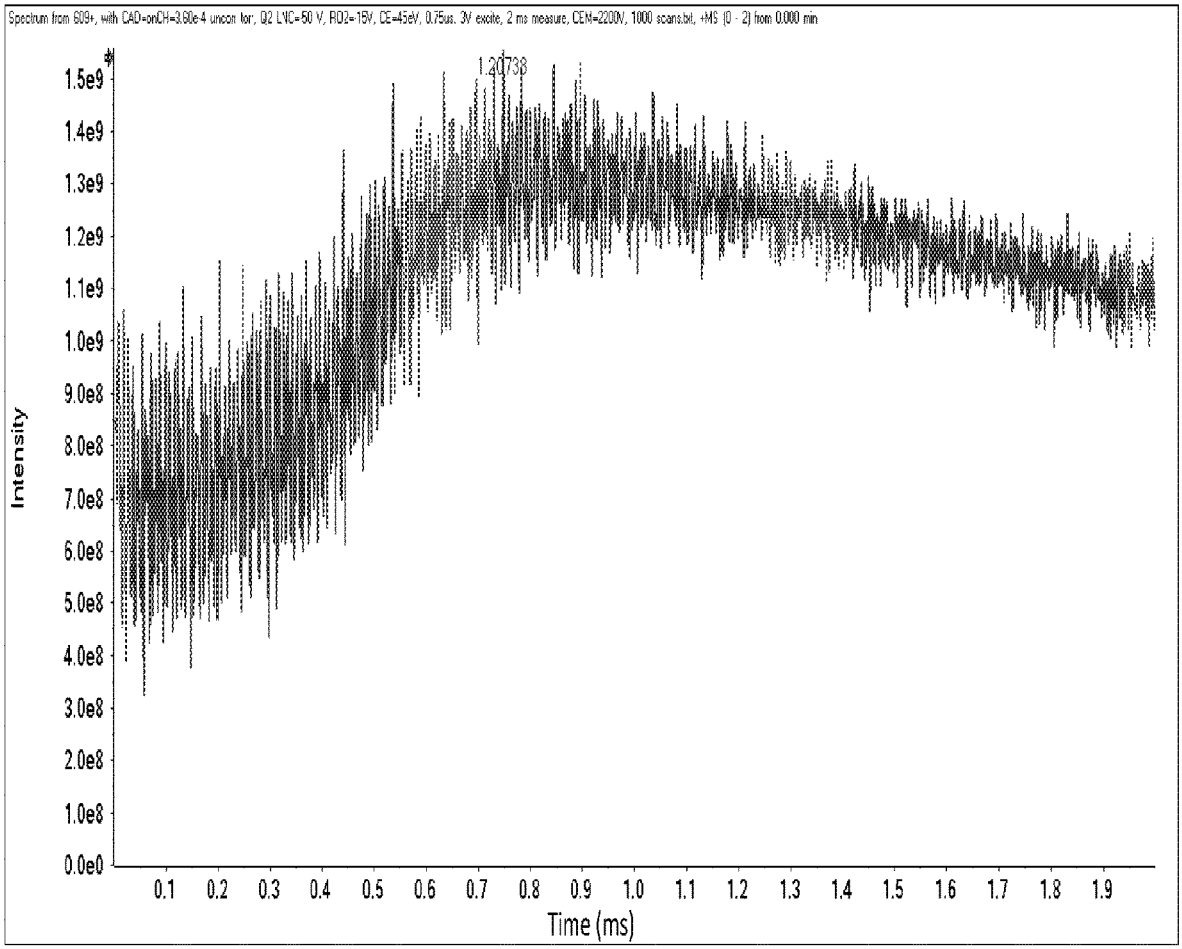
FIG. 10 shows oscillatory ions signal with many frequency components corresponding to a plurality of products ions generated by the fragmentation of the reserpine m/z 609 ion using a mass analyzer according to an embodiment of the present teachings.
Figure 11:
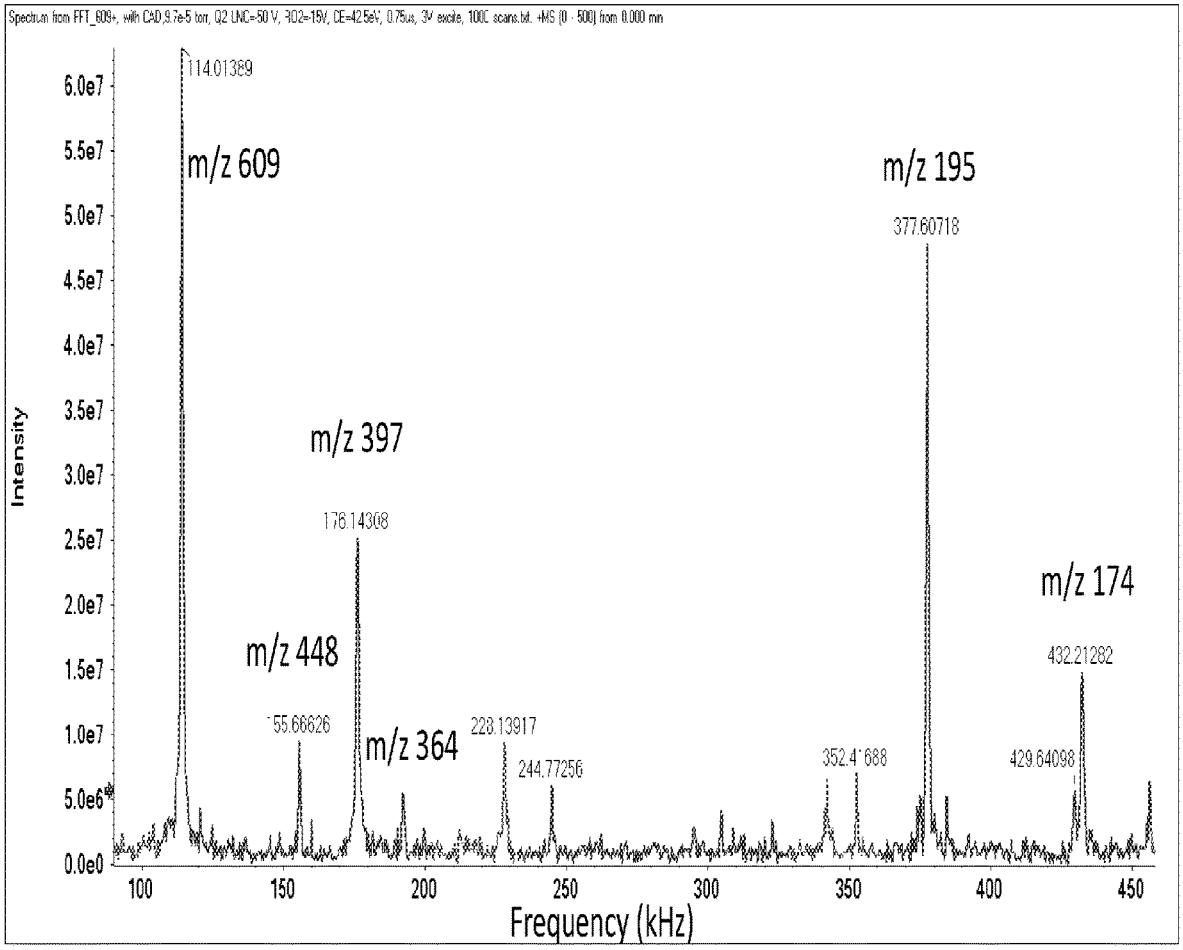
FIG. 11 is a Fourier transform of the oscillatory ion signal shown in FIG. 10, and FIGS. 12A and 12 B show the frequency spectra of the mass selected m/z 609 reserpine ion at two collision energies at a chamber pressure of $1.4\times10^{-3}$ Torr.

When there are ions of many different mass-to-charge ratios, the resultant oscillatory signal can be quite complicated, as is shown in FIG. 10. The trace in FIG. 10 was acquired for an ion beam of Q1 mass selected protonated reserpine (0.17 pmol/uL solution) at m/z 609 accelerated into the pressurized Q2 collision cell at 42.5 eV to produce fragment ions. The Q3 RF voltage was fixed at 640 V (0-peak). When the data depicted in FIG. 10 was Fourier transformed, the frequency spectrum in FIG. 11 was obtained. This is the product ion spectrum of reserpine. The frequencies and associated m/z values are shown in the spectrum.

Figures 12A, 12B:
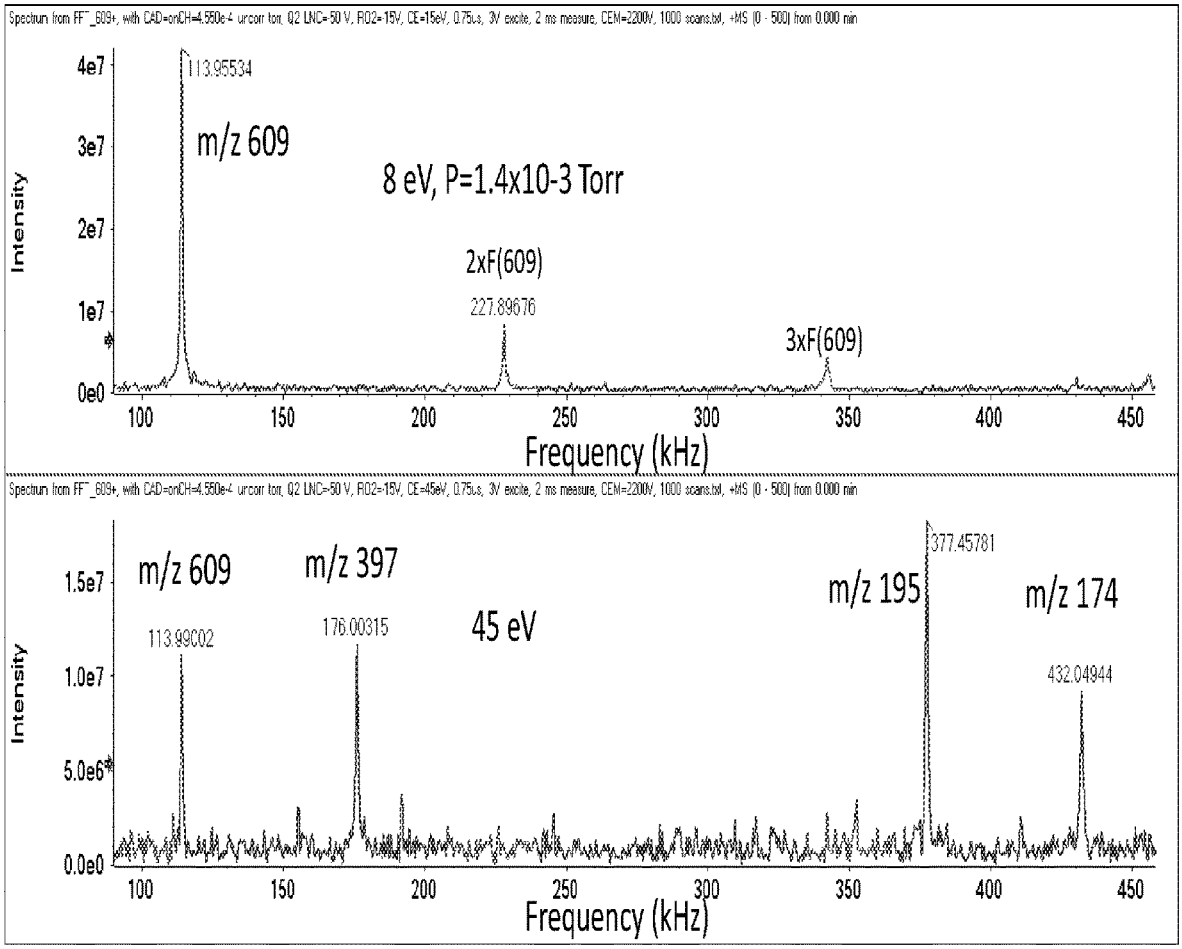

It has been found that this analyzer functions with virtually no loss of performance at much higher operating pressures than a conventional quadrupole mass filter, which is normally restricted to pressures $<1\times10^{-4}$ Torr. This is shown in FIGS. 12A and 12B, in which the Fourier transformed spectra for reserpine protonated molecular ion at m/z 609 are presented for two different Q2 collision energies: 8 eV and 45 eV. Q1 was set to transmit a 5 amu wide window around the m/z 609 reserpine ion, and the Q3 RF voltage was fixed at 640 V (0-peak). The excitation conditions are 750 ns wide dipolar pulse at 40 V. The chamber pressure was increased to $1.4\times10^{-3}$ Torr using an external nitrogen gas supply. Despite the high chamber pressure, quite acceptable spectra were obtained at both collision energies.

Those having ordinary skill in the art will appreciate that various changes can be made to the above embodiments without departing from the scope of the invention. Further, one of ordinary skill in the art would understand that the features of one embodiment can be combined with those of another.

What is claimed is:

1. A mass analyzer, comprising:

a quadrupole having an input end for receiving ions and an output end through which ions can exit the quadrupole, said quadrupole having a plurality of rods to at least some of which an RF voltage can be applied for generating a quadrupolar field for causing radial confinement of the ions as they propagate through the quadrupole and further generating fringing fields in proximity of said output end, at least a voltage source for applying a voltage pulse having a duration in a range of about 10 ns to about 100 microseconds to at least one of said rods so as to excite radial oscillations of at least a portion of the ions passing through the quadrupole at secular frequencies thereof, wherein the radially-excited ions interact with the fringing fields as they exit the quadrupole such that their radial oscillations are converted into axial oscillations indicative of fundamental secular frequencies of the radially-excited ions exiting the quadrupole, a detector disposed downstream of said output end of the quadrupole for detecting said ions exiting the quadrupole so as to generate a time-varying ion signal exhibiting temporal oscillations containing information about the secular frequencies of the radially-excited ions in response to detection of said ions exiting the quadrupole, and an analysis module for receiving said time-varying ion signal and applying a Fourier Transform to said time-varying ion signal so as to generate a frequency domain signal providing information regarding said secular frequencies of the radially-excited ions, wherein said analysis module is configured to operate on said frequency-domain signal to extract said secular frequencies of the radially excited ions for generating a mass spectrum of said radially-excited ions exiting the quadrupole.

2. The mass analyzer of claim 1, wherein said voltage pulse has a duration in a range of about 1 microsecond to about 5 microseconds.

3. The mass analyzer of claim 1, wherein said voltage pulse has an amplitude in a range of about 10 volts to about 40 volts.

4. The mass analyzer of claim 1, wherein said voltage pulse has an amplitude in a range of about 20 volts to about 30 volts.

5. The mass analyzer of claim 1, wherein said quadrupole is maintained at a pressure in a range of about $1\times10^{-6}$ Torr to about $9\times10^{-3}$ Torr.

6. The mass analyzer of claim 5, wherein said quadrupole is maintained at a pressure in a range of about $8\times10^{-6}$ Torr to about $1\times10^{-4}$ Torr.

7. The mass analyzer of claim 1, wherein said voltage source applies said voltage pulse across at least a pair of auxiliary electrodes.

8. The mass analyzer of claim 1, wherein said at least one voltage source is configured to apply a DC or an RF voltage to an exit lens so as to adjust said fringing fields in proximity of said output end of the quadrupole.

9. A method of performing mass analysis, comprising:

passing a plurality of ions through a quadrupole rod set comprising a plurality of rods, said quadrupole rod set comprising an input end for receiving the ions and an output end through which ions exit the quadrupole rod set, applying at least one RF voltage to at least one of said rods so as to generate an RF field for radial confinement of the ions as they pass through the quadrupole, applying a voltage pulse having a duration in a range of about 10 ns to about 100 microseconds across at least one pair of said plurality of rods so as to excite radial oscillations of at least a portion of the ions passing through the quadrupole rod set at secular frequencies thereof, wherein fringing fields in proximity to said output end convert said radial oscillations of at least a portion of said excited ions into axial oscillations as said excited ions exit the quadrupole rod set, detecting at least a portion of said ions exiting the quadrupole rod set to generate a time-varying ion signal exhibiting temporal oscillations containing information about the secular frequencies of the radially-excited ions, and obtaining a Fourier Transform of said time-varying ion signal so as to generate a frequency-domain signal providing information regarding secular frequencies of the radially excited ions and utilizing said frequency-domain signal to generate a mass spectrum associated with the detected ions.

* * * * *